United States Patent [19]

Köhler et al.

[11] 3,990,816

[45] Nov. 9, 1976

[54] DOUBLE ACTING PISTON PUMP FOR CRYOGENIC MEDIUM

[75] Inventors: Hubert Köhler, Eltersdorf; Günther Matthäus, Spardorf; Fritz Schmidt, Erlangen, all of Germany

[73] Assignee: Siemens Aktiengesellschaft, Munich, Germany

[22] Filed: Nov. 9, 1972

[21] Appl. No.: 304,902

[30] Foreign Application Priority Data

Nov. 9, 1971 Germany ..... 2155624

[52] U.S. Cl. ..... 417/536; 417/901

[51] Int. Cl.[2] ..... F04B 21/02; F04B 39/10

[58] Field of Search ..... 417/534–536, 417/901, 571

[56] References Cited

UNITED STATES PATENTS

| | | | |
|---|---|---|---|
| 1,930,731 | 10/1933 | Thompson | 477/534 |
| 2,018,144 | 10/1935 | Mesinger | 417/901 |
| 2,290,829 | 7/1942 | Edwards | 417/536 |
| 2,972,960 | 2/1961 | Philip | 417/901 |
| 3,083,648 | 4/1963 | Putman | 417/901 |
| 3,180,096 | 4/1965 | Peterson | 60/436 |
| 3,212,280 | 10/1965 | Thomas et al. | 417/901 |
| 3,279,391 | 10/1966 | Masciopinto | 417/901 |
| 3,422,765 | 1/1969 | Schock | 417/901 |
| 3,478,956 | 11/1969 | Gosha | 417/534 |
| 3,692,438 | 9/1972 | Schapol | 417/901 |

FOREIGN PATENTS OR APPLICATIONS

| | | | |
|---|---|---|---|
| 1,140,605 | 3/1957 | France | 417/571 |
| 364,445 | 8/1938 | Italy | 417/534 |

*Primary Examiner*—William L. Freeh
*Attorney, Agent, or Firm*—Kenyon & Kenyon Reilly Carr & Chapin

[57] ABSTRACT

A double acting piston pump for cryogenic mediums is disclosed. The pump includes a vertically positioned cylinder having a base portion and a cover portion, and inlet valves are disposed in the cover portion and the base portion for admitting the cryogenic medium into the cylinder and for providing a pressure component of approximately zero against the direction of flow of the cryogenic medium. Outlet valves are disposed in the cover portion and the base portion for discharging the cryogenic medium from the cylinder. A piston is slideably mounted in the cylinder and a drive rod connected to the piston extends through either the cover portion or the base portion of the cylinder. A drive arrangement engages the drive rod for actuating the piston. A housing is also provided which has a portion defining the cylinder. The drive rod and the drive arrangement are mounted in the remaining portion of the housing, whereby the housing is common to the piston, the drive rod and the drive arrangement. The pump is suitable for both liquid and gaseous mediums and generates practically no frictional forces.

7 Claims, 2 Drawing Figures

DOUBLE ACTING PISTON PUMP FOR CRYOGENIC MEDIUM

BACKGROUND OF THE INVENTION

The invention relates to a double-acting piston-pump for cryogenic mediums. The pump has a piston disposed in a vertical cylinder having a base and a cover. The base and cover each are provided with an inlet and an outlet valve. A drive rod for the piston extends through either the cover or base of the cylinder. The pump is suitable for both liquid and gaseous cryogenic mediums such as helium, nitrogen, hydrogen and the like. Practically no frictional forces are produced by the pump so that the pumped cooling liquid can therefore not evaporate.

Cooling circuits for conducting a cryogenic fluid such as liquid helium or liquid nitrogen are required for cooling electrical apparatus having superconductors such as a super conducting cable and the like. Pumps are provided to circulate such cryogenic liquid and operate within a secondary circuit.

With such cooling circuits, there are two different forms of operation. In the first, the heat is carried away through evaporation of the cooling liquid. A two-phase mixture composed of liquid and of gas then circulates in the cooling circuit. In the second form of operation the cooling liquid is circulated in a single-phase liquid state under pressure with fixation of the boiling point by means of a heat-exchanger. The heat is carried away above the specific heat of the cooling liquid. The operational pressure in the circuit can be adjusted by means of the gas stored in a vessel. The pumping pressure of the pump serves only to overcome the flow losses in the cooling circuit.

When placing a cooling circuit of liquid helium into operation, first the circuit can be tanked with liquid from a cryostat by means of a cold valve. After an initial accumulation of gas, a two-phase mixture circulates so that by switching the cold-valve, it is possible to switch over the operation to a circuit under pressure having a fixed boiling point. This results in a further requirement for the characteristics of a pump for cryogenic mediums; namely, the use of a mixed circuit. With such a pump the time for filling the circuit can be kept small. Furthermore, such a cryopump must meet other requirements: the throughput of cooling liquid must be constant and be variable over a great range. The pump should also be able to pump cold as well as warm gas.

For pumping liquid helium in liquid nitrogen, some special requirements also have to be met in the constructional configuration of the pump, because, at very low temperatures, the various materials undergo great and different contractions. At the temperature of liquid helium for example metals shrink up to about 0.4% and synthetic materials, used as sealing materials, shrink as much as 2.4%. Furthermore, the elasticity of the materials also alters. For example, rubber and synthetic substances become hard and brittle. It is generally not possible to use lubricants, because of the danger of contaminating the pumped cryogenic liquids, and because they become solid at low temperatures. Disturbances through congealing gas in the internal spaces of the pump during cool-down are to be avoided. Helium tends to oscillate in pipes, and should not be excited into such oscillations by the pump.

In order to provide a cooling circuit having increased pressure, care must also be taken that all parts of the pump are constructed for such an operating pressure. This requires in particular adequate sealing of the pump housing against the corresponding over-pressure. On the one hand, the passages through the cylinder wall for the drive rod for the piston must be adequately sealed; and on the other hand, such a sealing of the drive rod against the operative pressure produces an unallowable increase of frictional losses during the motion of the piston. This pressure-tight passage therefore forms an unallowable source of heat for the entire arrangement.

Rotary pumps are not suitable for pumping helium, because of the low density of helium, and because such pumps are able to produce only a small pressure difference in correspondence to the relative density. Bucket-wheel pumps, gearwheel pumps, and Roots pumps which develop pressure while rotating are indeed capable of producing a substantially higher pressure difference. However, their use depends in particular on the configurations possible relating to heat-technology with respect to production of gas, or of gas losses, at the various rotary speeds. Furthermore, such pumps have the usual mechanical elements such as passages for rods and stuffing boxes which create considerable operational difficulties. Such pumps are moveover generally not suitable for pumping gas.

In contrast, piston pumps and membrane pumps have the advantage that their volumetric throughput is variable, and that great pumping heads are possible with small throughputs. They are also capable of pumping cold and warm gases. There are also many construction possibilities available in selecting the drive for the pistons. It is for example possible to make use of a crank-drive, of a solenoid on the outside, or even of a superconductive coil-drive inside the cryogenic vessel.

In the case of a membrane-pump system, the quality of the spring-bellows is of primary importance with reference to its life and the maximum attainable number of strokes per minute. Tombac is a suitable spring-bellows material; and the spring constant at the temperature of liquid helium is also less than at room temperature. The life of such tombac undulated members is, however, at $10^5$ to $10^6$ strokes, relatively short. In a pump for cryogenic liquids known from the journal *Cryogenics* April 1965, pages 107 to 109, the undulated member is therefore made of nickel. There is provided for the drive of the known pump, a superconductive alternating-current magnet that brings a niobium ring into oscillation. Through use of the superconductor, this pump is however limited to pumping helium. Furthermore, the undulated member permits no great pressure, and pumps only a limited quantity, because with such pumps, the stoke is limited to a few percent of the length of the undulated member, so that the elastic limit of the material of the undulated member may not be exceeded.

The requirements for a pump for cryogenic mediums, as described at the outlet, are therefore best met by a piston-pump immersed in the cooling liquid. The journal *Review of Scientific Instruments*, volume 41, No. 10, pages 570 to 573, describes a piston-pump whose cylinder consists of nonmagnetic material. The piston is carried along by two ring-magnets situated outside the cylinder and, guided by a guide-shaft, and driven by a drive-rod. This cylinder material however has only poor heat conduction, and through the normally-conductive magnets, a relatively great inflow of heat is obtained. It is therefore unsuitable for helium.

In the journal *Advances in Cryogenic Engineering*, volume 11, 1965, pages 530 to 535, a pump is described that works on the principle of a double-piston arrangement, which indeed makes possible a constant pumping; however, the removal of the heat is poor because of the use of high-grade steel, and its dead volume is realtively great. Consequently the quantity pumped in operation diminishes. The filling in the outer space of the cylinder evaporates, and thus the pumping becomes irregular.

U.S. Pat. No. 3,456,595 discloses a pump for cryogenic liquids which has a piston that moves in a vertical cylinder. A drive-rod for this piston passes through the cover of the cylinder. The cover and base each contain one induction valve and one outlet valve. The cylinder is first filled with a gas-liquid mixture. As the piston moves, first an excess of liquid flows through openings in the cylinder wall, which act as auxiliary valves, and returns to the liquid tank. Then the liquid-gas mixture becomes compressed, through which the gas becomes liquified again. Only then do the outlet valves open. Because of the openings in the cylinder wall it is not possible to operate with over-pressure. A closed circuit for the pumped medium is also not possible.

It has now been found that a pump that is to meet all the foregoing requirements must be constructed in such a way that the pumped cryogenic liquid shall not evaporate during the pumping. Consequently it is necessary to prevent practically any introduction of heat from the outside, and also, above all, to prevent any unallowable generation of heat by the pump itself. These requirements can only be met when only a negligible quantity of frictional heat is introduced at the passage for the drive rod and, if at the same time, any considerable flow losses in the inlet and outlet conduits for the cooling medium directly at the pump cylinder is prevented, particularly in the inlet and outflow valves.

SUMMARY OF THE INVENTION

It is an object of the invention to provide a double-acting piston for cryogenic mediums that avoids the disadvantages of the known pumps while at the same time meeting all the requirements as set forth above.

The double-acting piston pump of the invention includes as a feature a vertically positioned cylinder having a base portion and a cover portion. Respective inlet valves are disposed in the cover portion and the base portion for admitting the cryogenic medium into the cylinder and for providing a pressure component of approximately zero value against the direction of flow of the cryogenic medium. Respective outlet valves are disposed in the cover portion and the base portion for discharging the cryogenic medium from the cylinder. A piston is slideably mounted in the cylinder and a drive rod connected to the piston and extends through the base portion or the cover portion. Drive means engages the drive rod for actuating the piston. A housing is provided and has a portion defining the cylinder. The drive rod and said drive means are mounted in the remaining portion of the housing whereby the housing is common to the piston, the drive rod and the drive means.

The cryogenic medium flows into the cylinder before any noticeable underpressure occurs. A suction action of the inlet valve therefore is practially nonexistant. This pump can be constructed for a high pressure in the circuit, and it delivers an at least approximately constant flow of liquid. Because the drive-rod is arranged in the pump housing, the passage of this rod through the cylinder wall of the cryogenic medium does not have to be sealed against the operating pressure. Therefore only small frictional heat is produced in this passage.

The inlet valve in the bottom of the cylinder can advantageously be made without a pressure-spring. If the pump is provided for pumping a two-phase mixture, or for pumping exclusively only a gaseous medium, then the upper inlet valve can be provided with a very weak pressure-spring. The spring force is then advantageously made so that it is approximately equal to, or at least not substantially greater than the weight of the valve-plate. Thus, the spring force has in effect only the function of compensating the weight of the value-plate. In the case where the pump is intended to pump only cryogenic liquids, for example liquid helium or liquid nitrogen, under certain circumstances it is also possible to construct both inlet valves as plate-valves without a valve-spring. The flow losses in the pump can be kept small through a suitable configuration both of the valves and also of the piping in the vicinity of the valves. The flow cross-section in the valves is for this reason preferably not substantially smaller than, but is even in particular equal to or greater than, the flow cross-section in the connected conduits. In addition, the piping of the pump, and in particular its branchings, are constructed so that turbulence in the piping is small.

Although the invention is illustrated and described herein as a double-acting piston pump for cryogenic mediums, it is nevertheless not intended to be limited to the details shown, since various modifications may be made therein within the scope and the range of the claims. The invention, however, together with additional objects and advantages will be best understood from the following description in connection with the accompanying drawings.

DESCRIPTION OF THE PREFERRED EMBODIMENTS OF THE INVENTION

Figure 1:
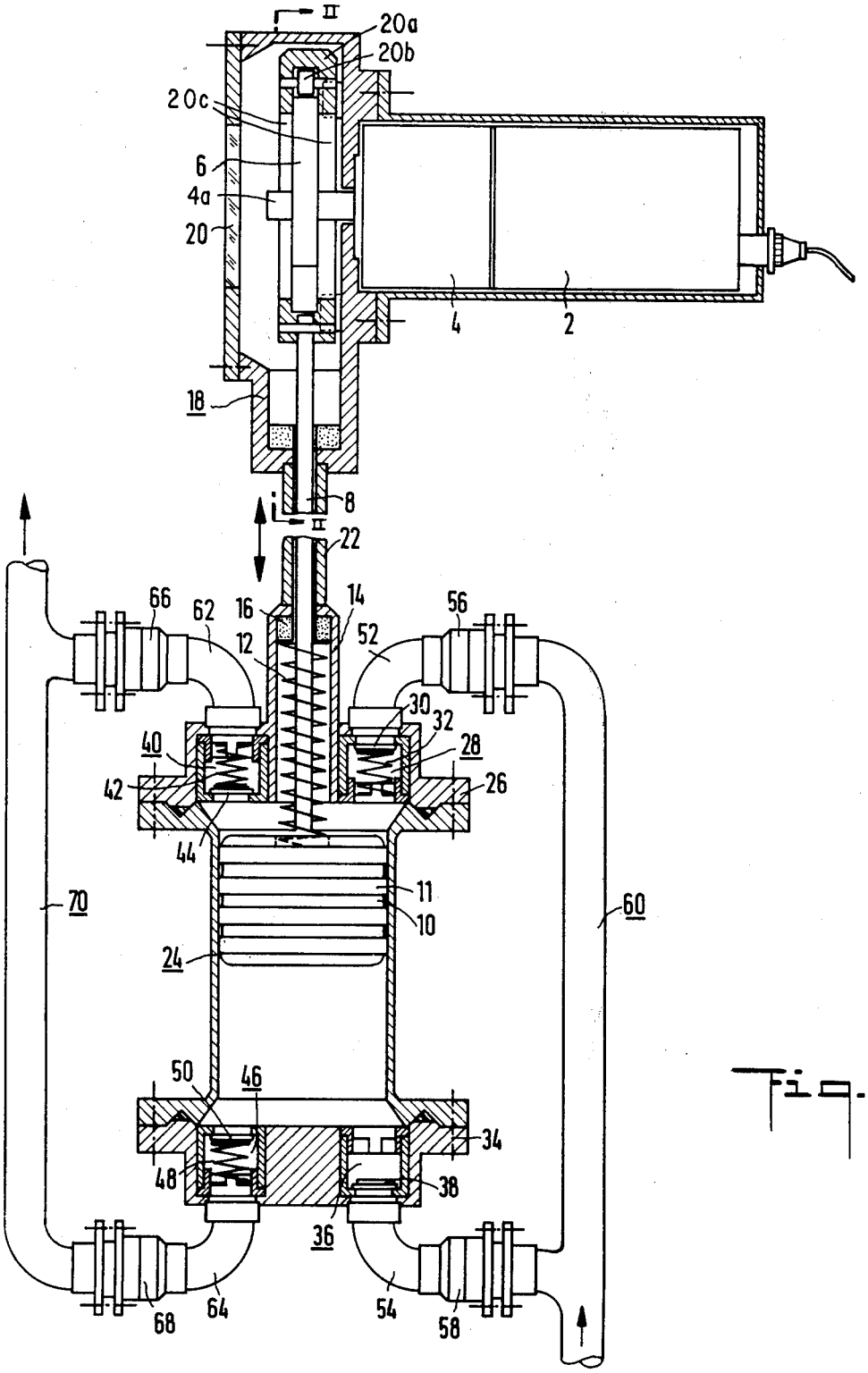
FIG. 1 is an elevation view, partially in section, of a double-acting piston pump according to the invention.
Figure 2:
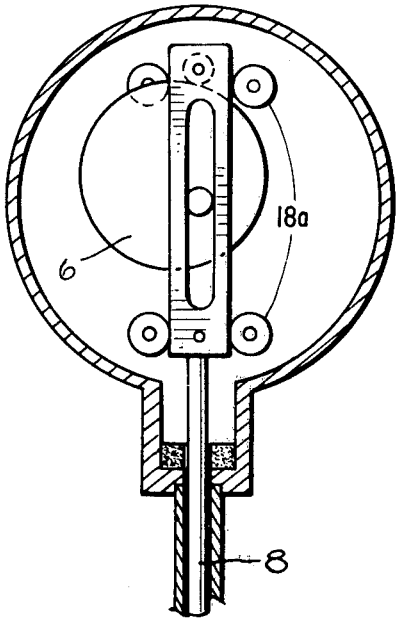
FIG. 2 is a view, partially in section, taken along the line II—II in FIG. 1; this view shows the coupling of the drive-rod to the gear mechanism of the drive assembly.

In the pump of the invention, a direct-current motor 2 is used to produce the drive force. The motor 2 can be, for example, for 220 volts and have a capacity of 60 watts. The motor 2 drives a piston 10 through an axial spur-gear mechanism 4 having a reduction ratio of, for example, 15:1 and a torque of, for example, 3N-m, as well as a cam 6 and a drive-rod 8 The motor 2, the spur-gear mechanism 4 and the cam 6 constitute drive means which engages the drive-rod 8 for actuating the piston. The peripheral profile of the cam 6 is preferably such that the motion of the piston 10 is a sinusoidal function. The cam 6 and its connection with the drive-rod 8 can be viewed as engagement means of the drive means; this connection is illustrated in FIG. 2. Cam 6 is mounted on a shaft 4*a* of spur gear mechanism 4, and is slidably disposed within a hollow, slotted coupling member 20*a* which is coupled to drive rod 8. The coupling member is supported on the cam surface of cam 6 by means of a roller bearing 20*b* disposed therewithin, and includes elongated slots 20*c* on each side of cam 6 through which shaft 4*a* extends. The coupling member is quided within drive-housing 18 by a plurality of cylindrical, rotatable guide members 18*a* mounted on an inside surface of the housing. Cam 6 is eccentrically mounted on shaft 4*a* so that rotational movement thereof lifts coupling member 20*a* within housing 18 in sinusoidal manner and produces reciprocating motion of piston 10. The drive-motor 2 can thus advantageously be provided only to produce the upward movement of the piston 10. Then the drive-rod 8 need transmit only a pulling force, and can therefore be configured as a thin-walled tube having a correspondingly low beat conductiviey. The introduction of heat via the thin tube to the piston 10 and therewith to the cooling medium is correspondingly small. The downward movement of the piston 10 can then be produced by spring force. For this purpose there can be provided, for example, resilient means in the form of a coil-spring 12, which is sidposed between the piston 10 and a passage 14 through the housing. This passage 14 through the housing contains a seal 16. The pulling rod 8 can advantageously be made of high-grade steel, which has good strength and which is a poor conductor of heat. The cam 6 is disposed in a drive-housing 18 having a viewing window 20; this window 20 makes it possible to observe the operation of the drive. The drive housing 18 is connected with the passage 14 of a pump-cylinder 24 through a tubular connection 22. The piston 10 is moved in the cylinder 24. The connection 22 can advantageously also be made of a thin-walled tube, which ensures only a small introduction of heat to the pump housing 24. The cover 26 of the pump-cylinder 24 is provided with an inlet valve 28, which is advantageously provided as a plate-valve having a plate 30 and a valve-spring 32. The base 34 of the cylinder 24 contains another inlet valve 36, which is likewise advantageously made as a plate-valve. The valve pressure counter to the direction of flow of the cooling medium can be kept small in that this valve is made without a valve-spring. The working of the valve is then produced exclusively by a plate 38.

In the cover 26 there is provided an outlet valve 40 which comprises a valve-spring 42 and a valve-plate 44. A similarly configured outlet valve 46 having a valve-spring 48 and a valve-plate 50 is provided in the base 34 of the pump-cylinder 24. Inlet tubes 52 and 54 feed into inlet valves 28 and 36 respectively; these inlet tubes 52 and 54 are connected by couplings 56 and 58 respectively to a supply line 60 for the cooling medium. In the same way, outlet valves 40 and 46 are connected to a flow-off conduit 70 for the cooling medium through outlet tubes 62 and 64 respectively as well as through couplings 66 and 68 respectively.

The pump-cylinder 24 can be made of a material which is a good conductor of heat and especially a material which develops only small friction losses such as copper. A suitable material for the piston 10 is preferably a copper alloy such as brass or the like. For sealing the two parts of the inner space of the cylinder from one another there are provided seal-rings 11 which slide along the inner wall of the cylinder 24. These seal-rings 11 must have particularly good sliding characteristics, and must also, at low temperatures, contract only a little, or at least not contract substantially more than the cylinder 24. This requirement for the seal-rings is met by a synthetic substance in which there is embedded a metal such as bronze or the like in a finely comminuted form.

In the embodiment shown wherein the drive motor 2, the drive-rod 8 and piston 10 are enclosed in a common housing, the pump cannot become damaged in the event that the piston 10 becomes frozen in the cylinder 24. The motor 2 then pulls the clamped piston 10 only in the upper end position. Because the force of the spring 12 is no longer able to move the piston 10, the piston drive continues to run without load. This no-load operation can be observed through the leakproof inspection window 20 in the drive-housing 18.

When the cooling circuit is put into operation while the pipes 60 and 70 together with the pump are still at room temperature, there can consequently be expected an intermittent great accumulation of gas with a corresponding rise of pressure. In this situation, the pumping process is dicontinued by idling of the drive until the pressure in the pipes 60 and 70, and in the connections 52 and 54 and also 62 and 64, has become equalized or has become less than the pressure of the spring 12. This avoids oscillations when helium is to be moved by the pump, and also optimum tanking times are obtained when the cooling circuit is placed in operation. The drive parts, namely: the motor 2, the gearing 4 and also the cam 6 and the drive rod 8 are situated in the housing 18 having the connecting portion 22. These parts can advantageously be made of nickel-plated steel. The cryogenic medium is prevented from ascending out of the cylinder 24 into the connecting portion 22 by the passage 14 which is configured as a stuffing box provided with expanded graphite as a sealing material. This stuffing-box however does not have to seal the high pressuree of the circuit against the atmosphere. Furthermore, this stuffing-box can advantageously by made adjustable, so that in addition, the friction, and thus the developed heat, can be kept negligibly small.

By means of the arrangement of one inlet valve and one outlet valve above and below the piston 10, in the cylinder covers 26 and 34 respectively, a double functioning of the piston-pump is obtained with a stroke at each upward and downward movement of the piston 10.

The pump is suitable for moving boiling liquid, that is for an open cooling circuit, and for cooling liquid that is just under its boiling point. Only a slight decrease of pressure through suction would cause the liquid to evaporate. For this reason, the valves are configured and arranged so that the cooling medium, in the case of an open circuit, flows through the static column of liquid without even a noticeable decrease of pressure into the cylinder 24. In the case of a closed circuit, the cooling medium becomes forced immediately into the space becoming available.

This function is fulfilled in an advantageous way by plate-valves having plates 30 and 38 respectively of very small mass, as well as plates 44 and 50 respectively, in association with an at least very small spring force, or even no force at all, for the inlet valves 28 and 36. The valve-plates can advantageously be made of thin little plates of duralumin metal, having a weight of for example 0.5 p. (1 $p = 1$ gram at standard gravity). The diameter may be 12.8 mm for example. For the lateral guidance of the valve-plates there may for example be provided in each valve four lobes offset at 90°. The two outlet valves 40 and 46 may each be provided with a somewhat heavier coil spring, which may for example be made of high-grade steel and have a spring force of 10 *p*.

The upper inlet valve 28 can be provided with a valve-spring 32, in the event that the pump is intended to pump a gaseous medium or a two-phase mixture. Then the force of the spring 32 is made such that it is just equal to the weight of the valve-plate 30. If the pump is provided to pump a liquid medium, then the valve-spring may be dispensed with.

When the valve-plates open, they are lifted for example about 33 mm and are pressed against an annular cage in the valve insert. The general cross-section of the pipes 60 and 70 respectively, along with that of the associated connection pipes 52, 54, 62 and 64, is preferably also maintained in the couplings 56, 58, 66 and 68, as well as in the valve 28, 36, 40 and 46. Good sealing of the individual valve-plates against their seat is obtained by grinding the surface of the plates.

The pump shown in the drawing can be constructed for a volumetric throughput of many thousands of liters hourly for example.

In the illustrated embodiment, the drive-rod 8 extends through the cover 26 of the cylinder 24 and the drive is disposed above the pump, It is however also possible to construct the pump with the drive-rod 8 going through the base 34 of the pump, the drive being accordingly disposed below the pump.

A particular advantage of the pump is that it is able to pump both liquid as well as gaseous cryogenic mediums. It is thus possible to first fill the circuit with a gaseous medium that becomes liquified gradually with increasing cooling and correspondingly decreasing temperature.

In a closed cooling circuit, for example for liquid helium as a coolant, the pump together with at least one heat-exchanger can be set in a cooling-liquid tank with liquid helium. The cooling circuit may contain for example, a superconductive cable as the object to be cooled. For placing this circuit into operation, gaseous helium can flow, for example, from gas-containers into the circuit. The gas circulated by the pump in the circuit becomes steadily cooled down in the heat-exchanger. With a pressure regulator in the gas supply line, the overpressure in the cooling circuit can be adjusted to any desired valve, this being preferably made such that a boiling of the liquified helium in the circuit is prevented. The critical overpressure required for this can be maintained by controlling or regulating. The equipment that is to be cooled thus becomes cooled down steadily, and is held at a predetermined temperature.

What is claimed is:

1. A double-acting piston pump for liquid and gaseous helium comprising:

a vertically positioned cylinder having a base portion and a cover portion;

respective inlet valves disposed in said cover portion and said base portion for admitting the helium into said cylinder and for providing a pressure component of approximately zero against the direction of flow of the helium;

respective outlet valves disposed in said cover portion and said base portion for discharging the helium from said cylinder, said inlet and said outlet valves having a given flow cross-section;

respective supply conduits communicating with said inlet valves for supplying the helium thereto, and respective discharge conduits communicating with said outlet valves for conducting the helium therefrom, said inlet and outlet valves having a flow cross-section which is at least approximately the same as said flow cross-section of said conduits;

a piston slideably mounted in said cylinder;

a drive rod connected to said piston and extending through one of said portions;

drive means engaging said drive rod for actuating said piston; and a housing having a portion defining said cylinder, said drive rod and said drive means being mounted in the remaining portion of said housing whereby said housing is common to said piston, said drive rod and said drive means.

2. The double-acting piston pump of claim 1, said inlet valve in said cover portion being a plate valve.

3. The double-acting piston pump of claim 1, said inlet valve in said base portion being a plate valve.

4. The double-acting piston pump of claim 3, said plate valve consisting of a plate movably mounted in said base portion.

5. The double-acting piston pump of claim 4, said inlet valve in said cover portion being a plate valve consisting of a plate movably mounted in said cover portion.

6. A double-acting piston pump for liquid and gaseous helium comprising:

a vrtically positioned cylinder having a base portion and a cover portion;

respective inlet valves disposed in said cover portion and said base portion for admitting the helium into said cylinder and for providing a pressure component of approximately zero against the direction of flow of the helium;

respective outlet valves disposed in said cover portion and said base portion for discharging the helium from said cylinder, said inlet and said outlet valves having a given flow cross-section;

respective supply conduits communicating with said inlet valves for supplying the helium thereto, and respective discharge conduits communicating with said outlet valves for conducting the helium therefrom, said inlet and outlet valves having a flow cross-section which is at least approximately the same as said flow cross-section of said conduits;

a piston slideably mounted in said cylinder;

a drive rod connected to said piston and extending through one of said portions;

drive means engaging said drive rod for actuating said piston; and a housing having a portion defining said cylinder, said drive rod and said drive means being mounted in the remaining portion of said housing whereby said housing is common to said piston, said drive rod and said drive means, said inlet valve in said cover portion being a plate valve comprising a plate movably mounted in said cover portion, said plate having a weight corresponding to a predetermined force value, and a spring engaging said plate for developing a force with respect to the same having a value in the range extending from said force value to a value only slightly greater than said force value.

7. A double-acting piston pump for liquid and gaseous helium comprising:

a vertically positioned cylinder having a base portion and a cover portion;

respective inlet valves disposed in said cover portion and said base portion for admitting the helium into said cylinder and for providing a pressure component of approximately zero against the direction of flow of the helium;

respective supply conduits communicating with said inlet valves for supplying the helium thereto, and respective discharge conduits communicating with said outlet valves for conducting the helium therefrom, said inlet and outlet valves having a flow cross-section which is at least approximately the same as said flow cross-section of said conduits;

a piston slideably mounted in said cylinder;

a drive rod connected to said piston and extending through one of said portions;

drive means engaging said drive rod for actuating said piston; and a housing having a portion defining said cylinder, said drive rod and said drive means being mounted in the remaining portion of said housing whereby said housing is common to said piston, said drive rod and said drive means, said inlet valve in said cover portion being a plate valve comprising a plate movably mounted in said cover portion, and a spring engaging said plate for developing a force with respect to the same having a value approximately the same as the force corresponding to the weight of said plate.

* * * * *

UNITED STATES PATENT AND TRADEMARK OFFICE

CERTIFICATE OF CORRECTION

PATENT NO. : 3990816

DATED : November 9, 1976

INVENTOR(S) : Hubert Koehler et al

It is certified that error appears in the above-identified patent and that said Letters Patent are hereby corrected as shown below:

Col. 2, line 60: change "outlet" to --outset--;

Col. 3, line 9: change "realtively" to --relatively--;

Col. 4, line 17: change "value-plate" to --valve-plate--;

Col. 5, line 15: change "beat conductiviey" to --heat conductivity--;

Col. 5, line 21: change "sidposed" to --disposed--;

Col. 6, line 18: change "dicontinued" to --discontinued--;

Col. 6, line 34: change "presuree" to --pressure--;

Col. 6, line 35: change "by" to --be--;

Col. 7, line 11: change "33 mm" to --3 mm--;

Col. 7, line 45: change "valve" to --value--;

Col. 8, line 28: (Claim 6) change "vrtically" to --vertically--.

Signed and Sealed this

Twenty-second Day of March 1977

[SEAL]

*Attest:*

RUTH C. MASON
*Attesting Officer*

C. MARSHALL DANN
*Commissioner of Patents and Trademarks*